US009340392B2

(12) United States Patent
Messinides et al.

(10) Patent No.: US 9,340,392 B2
(45) Date of Patent: May 17, 2016

(54) EXTENDED LENGTH AND HIGHER DENSITY PACKAGES OF BULKY YARNS AND METHODS OF MAKING THE SAME

(75) Inventors: Michael Messinides, Rembert, SC (US); John Randall Mattis, Lugoff, SC (US); William Thomas Riley, Colombia, SC (US)

(73) Assignee: INVISTA North America S.ar.l., Wilmington, DE (US)

( * ) Notice: Subject to any disclaimer, the term of this patent is extended or adjusted under 35 U.S.C. 154(b) by 708 days.

(21) Appl. No.: 13/505,071

(22) PCT Filed: Oct. 29, 2010

(86) PCT No.: PCT/US2010/054671

§ 371 (c)(1),
(2), (4) Date: Jun. 26, 2012

(87) PCT Pub. No.: WO2011/053767

PCT Pub. Date: May 5, 2011

(65) Prior Publication Data

US 2012/0261503 A1 Oct. 18, 2012

Related U.S. Application Data

(60) Provisional application No. 61/256,744, filed on Oct. 30, 2009.

(51) Int. Cl.

| | |
|---|---|
| ***B65H 54/28*** | (2006.01) |
| ***B65H 54/08*** | (2006.01) |
| ***B65H 54/38*** | (2006.01) |
| ***B65H 55/04*** | (2006.01) |

(52) U.S. Cl.

CPC ..... *B65H 54/2884* (2013.01); *B65H 54/08* (2013.01); *B65H 54/38* (2013.01); *B65H 54/383* (2013.01); *B65H 55/04* (2013.01); *B65H 2701/31* (2013.01)

(58) Field of Classification Search

CPC .... B65H 54/06; B65H 54/08; B65H 54/2884; B65H 54/38; B65H 54/383; B65H 55/04; B65H 2701/31

See application file for complete search history.

(56) References Cited

U.S. PATENT DOCUMENTS 6,311,920 B1 * 11/2001 Jennings et al. ..... 242/477.6
2011/0203964 A1 * 8/2011 Koskol ..... 206/524.1

FOREIGN PATENT DOCUMENTS

WO WO 2010062530 A1 * 6/2010

* cited by examiner

*Primary Examiner* — William E Dondero
(74) *Attorney, Agent, or Firm* — Joseph N. Moonjely

(57) ABSTRACT

A method of winding bulked continuous filament yarn is disclosed, which enables superior yarn package formation, including higher density packages with excellent shape and yarn takeoff characteristics. The method uses unique helix angles and winding profiles in a non-adjacent and adjacent yarn pattern, achieved by a unique winding control strategy that constantly monitors spindle speed, desired wind ratio, traverse cam speed, and surface speed.

5 Claims, 5 Drawing Sheets

| Step | Wind Ratio | Starting Helix Angle (in °) | Ending Helix Angle (in °) |
|---|---|---|---|
| 1 | 12.72 | 9.477 | 9.136 |
| 2 | 11.379 | 10.192 | 9.828 |
| 3 | 10.391 | 10.742 | 10.384 |
| 4 | 9.7 | 11.106 | 11.057 |
| 5 | 9.29 | 11.532 | 10.874 |
| 6 | 8.439 | 11.94 | 11.376 |
| 7 | 8.392 | 11.438 | 10.890 |
| 8 | 7.08 | 12.846 | 12.231 |
| 9 | 6.367 | 13.553 | 12.893 |
| 10 | 6.21 | 13.208 | 12.565 |
| 11 | 5.843 | 13.326 | 12.709 |
| 12 | 5.367 | 13.795 | 13.168 |
| 13 | 4.99523 | 14.110 | 11.999 |
| 14 | 4.72 | 12.677 | 12.6 |
| 15 | 4.623 | 12.855 | 12.778 |
| 16 | 4.49571 | 13.127 | 13.048 |
| 17 | 3.99618 | 12.855 | 12.778 |
| 18 | 4.49571 | 13.127 | 13.048 |
| 19 | 3.49666 | 14.164 | 12.868 |
| 20 | 2.99656 | 14.926 | 11.630 |
| 21 | 2.49762 | 13.870 | 13.817 |
| 22 | 2.49600 | 13.825 | 13.733 |

FIG. 1B

| Step | Wind Ratio | Starting Helix Angle (in °) | Ending Helix Angle (in °) |
|---|---|---|---|
| 1 | 12.72 | 9.477 | 9.136 |
| 2 | 11.379 | 10.192 | 9.828 |
| 3 | 10.391 | 10.742 | 10.384 |
| 4 | 9.7 | 11.106 | 11.057 |
| 5 | 9.29 | 11.532 | 10.874 |
| 6 | 8.439 | 11.940 | 11.376 |
| 7 | 8.392 | 11.438 | 10.890 |
| 8 | 7.08 | 12.846 | 12.231 |
| 9 | 6.367 | 13.553 | 12.893 |
| 10 | 6.21 | 13.208 | 12.565 |
| 11 | 5.843 | 13.326 | 12.709 |
| 12 | 5.367 | 13.795 | 13.168 |
| 13 | 4.843 | 14.535 | 13.944 |
| 14 | 4.72 | 14.293 | 13.512 |
| 15 | 4.623 | 13.785 | 13.776 |
| 16 | 4.4966 | 14.148 | 12.513 |
| 17 | 3.9969 | 14.019 | 12.456 |
| 18 | 3.80576 | 13.061 | 13.054 |
| 19 | 3.4973 | 14.161 | 12.866 |
| 20 | 2.9970 | 14.921 | 11.605 |
| 21 | 2.99 | 11.634 | 11.613 |
| 22 | 2.8869 | 12.016 | 11.931 |

FIG. 2B

EXTENDED LENGTH AND HIGHER DENSITY PACKAGES OF BULKY YARNS AND METHODS OF MAKING THE SAME

CROSS-REFERENCE TO RELATED APPLICATION

This application claims benefit of priority from U.S. Provisional Application No. 61/256,744 filed Oct. 30, 2009.

This invention relates to packages of bulked continuous filament (BCF) yarns and other textured or "bulky" yarns having a greater length of yarn for a given yarn type and package size than similar packages of the same yarn wound according to methods of the prior art. The packages of the winding process disclosed herein have higher density measured in terms of net yarn weight per unit of package volume, providing a greater weight of yarn per yarn package of similar width and diameter, while the key quality attributes of bulk and interlace are maintained consistently throughout the package. The package of the disclosed invention is also more easily unwound than yarn packages of the prior art, with substantially reduced unwinding tensions observed at higher take-off speeds. Also disclosed herein are methods of making bulky yarns using unique helix angles, adjacent and non-adjacent wind ratios, and winding profiles.

BACKGROUND OF THE TECHNOLOGY

The mills of the North American carpet industry and their yarn suppliers handle over 200 million BCF yarn packages per year, consisting of yarn wound around heavy paper, plastic or composite rolls, called "tube cores." Each of these BCF packages normally contain from about 8 to 20 pounds of yarn, depending on the bulk of the yarn, where bulk is a measure of the space taken up by a given weight of yarn. The bulkier the yarn, the less weight the package generally contains. The carpet industry often uses tube cores, sometime multiple times, depending on the yarn type and the processes involved. However, the expense of cores is still a substantial cost item. Furthermore, it is important to understand that cost is incurred each time a package is handled, both in terms of manpower and from risk of damage to both the yarn and the tube core.

The physical dimensions of the BCF yarn package are not easily changed. The size and makeup of the standard BCF package is set by several factors, including the limitations of existing spinning, winding, and unwinding processes and equipment. For example, tube core diameter must be large enough to permit smooth unwinding, while it must also be strong enough to permit winding at high speed. The overall diameter of the BCF yarn package is also restricted, in one case by the standard twister bucket diameter, into which the package must fit. The stroke, or width of the yarn on the tube core is also set in accordance with existing equipment size and process limitations, including unwinding efficiency.

Several methods of increasing yarn package density have been employed. These include: tighter winding around the tube core and tighter yarn packing with overlapping loops. These methods, however, have their unique drawbacks, which include difficulty removing the yarn; loss in bulk property; decrease in package stability; and yarn falling off the core ends. To avoid the above problems, precision winding and random winding methods are used.

Precision Winding is typically used for textile yarns, which are fine denier and flat, meaning they are not bulk textured and so contain almost no "bulk" property. These yarns are typically textured in secondary steps, and the smoothness and uniformity of unwinding is most important to subsequent process productivity. Wound packages of textile yarn are also typically finer denier. Owing to these factors, textile yarn packages typically contain a very much greater length of yarn than BCF packages and both wind and unwind at higher speeds than is presently typical for BCF. A precision winding control method and winding profile designed to avoid ribbon formation is provided in U.S. Pat. No. 5,056,724 to Prodi and Albonetti, where operating limits are established, for example at the ribbon formation winding ratios, and then avoided. Another profile described in U.S. Pat. No. 6,311,920 to Jennings et al is designed to avoid package irregularities by winding adjacent to integral and sub-integral winding ratios and imposing a consistent offset from each winding ratio throughout the package.

For BCF yarn, it is customary to use a random wind profile in which a constant helix angle/wind ratio is maintained through adjusting spindle speed and traverse guide speed. The result of this approach is a random yarn lay pattern on the BCF package with varied spacing between the yarn threads throughout the package. This tends to provide a stable package with few winding problems, and it avoids the "ribbon" problem described above. A somewhat more advanced example of this approach maintains a constant crossing angle as yarn layers overlap on the package, such as is disclosed by Haak in U.S. Pat. No. 5,740,981, applied to both spindle driven and friction drive winding systems. Randomly wound packages vary greatly in packing density, depending especially on yarn bulk, where yarns of higher bulk make lighter weight packages.

BRIEF SUMMARY OF THE INVENTION

In recent years, the weight of yarn in a given set of package dimensions has been gradually reduced as BCF yarns have increased in bulk. For any given denier, this translates to shorter yarn lengths per package, with more tube cores and more package handling per unit of yarn and per yard of fabric. Thus, it can be understood that larger yarn packages might be desired to reduce cost per unit quantity of yarn if such packages could be used effectively.

Therefore, it is desirable to invent a winding method that could substantially increase the package density (yarn weight contained in a package of a specific size) of bulky yarns compared to randomly wound yarn packages, or precision wound packages of the prior technology. At the same time, it is also desirable to maintain or improve the yarn bulk level, bulk consistency, winding tension, package form stability, and package unwinding tension, compared to the prior winding methods.

The invention disclosed herein provides a yarn winding method to make BCF packages with an increase in packing density from about 2% to about 20%, including from about 7% to about 17%, and about 7% to about 11% (yarn weight contained in a package of a specific size) compared to randomly wound yarn packages, or precision wound packages of the prior methods. The BCF packages of the instant disclosure display higher yarn bulk level than the control yarn of the prior methods, with the same or superior bulk consistency and package form stability. Spinning winding tension is shown to be lower than the prior winding methods. Package unwinding tension is lower, compared to the prior methods, especially when unwinding the package at higher speed (e.g. as in package back-winding). Novel winder spindle and traverse guide control algorithms, that enable one skilled in the art to accomplish the disclosed profile with sufficient precision to be effective are also disclosed. Also provided are novel BCF packages made by the various aspects of the disclosed method.

In one aspect of the disclosed method, the bulky yarn is wound on a tube core using precision non-adjacent wind ratios until a package diameter between about 130 mm to about 180 mm, including from about 150 mm to about 180 mm, and from about 160 mm to about 180 mm, is achieved. At this point, adjacent integral and non-integral precision wind ratios can be used for the remainder of the yarn winding. Typical bulky yarn wound on a tube core has a final diameter of from about 250 mm to about 280 mm, including 275 mm. The final diameter includes a standard tube core diameter of 79 mm. A person of skill in the art would know that tube core diameters vary and how to modify the winding profile as such.

In another aspect of the disclosed method, the bulky yarn is wound on a tube core using non-adjacent random winding until a package diameter between about 130 mm to about 180 mm, including from about 150 mm to about 180 mm, and from about 160 mm to about 180 mm, is achieved. At this point, adjacent integral and non-integral precision wind ratios can be used for the remainder of the yarn winding.

In a further aspect of the disclosed method, the bulky yarn is wound on a tube core using a first non-adjacent set point with a first non-adjacent wind ratio and a first helix angle. The wind ratios are stepped increased to additional non-adjacent set points with non-adjacent wind ratios and helix angles greater than the first helix angle, until a package diameter of from about 130 mm to about 180 mm, including from about 150 mm to about 180 mm, and from about 160 mm to about 180 mm, is achieved. At this point, the wind ratios are step increased to at least one adjacent set point with at least one precision adjacent wind ratio and at least one helix angle greater than said first helix angle.

In yet a further aspect of the disclosed method, the bulky yarn is randomly wound on a tube core using a first non-adjacent set point with a first non-adjacent wind ratio and first helix angle. The wind ratios are step increased to additional set points until the package diameter is from about 130 mm to about 180 mm, including from about 150 mm to about 180 mm, and from about 160 mm to about 180 mm. Up to this point, the yarn is laid down on the tube core in a non-adjacent pattern. The wind ratios are then step increased to a least one adjacent set point with at least one precision adjacent wind ratio and at least one helix angle greater than said first helix angle.

In yet another aspect of the disclosed method, the bulky yarn is wound on a tube core using a series of wind ratio set points, more than 10 and less than about 30, including more than 15 and less than 25. Each set point starts at a specific wind ratio and helix angle, such that the helix angle gradually decreases from each initial set point with increasing package diameter, until a new set point is reached where a new wind ratio and higher helix angle is set, wherefrom the helix angle again gradually decreases until the next set point. The helix angle at the starting (or jump) point for each set point of the disclosed method ranges from about 9 degrees at the package core and gradually increases at the jump points to about 15 degrees at the peak, and then recedes to about 11 degrees at the jump points at the outer layers of the BCF package. Non-adjacent wind ratios can be used for the first 50% to 75% of the set points, while adjacent wind ratios can be used for the remaining 25% to 50% of the set points.

In a further aspect, a bulky yarn wound on a tube core having a packing density of from about 0.4 grams per $cm^3$ to about 0.6 grams per $cm^3$, including from about 0.5 grams per $cm^3$ to about 0.55 grams per $cm^3$, is disclosed. This yarn can be wound using non-adjacent wind ratios until the package diameter reaches about 130 mm to about 180 mm, including from about 150 mm to about 180 mm, and from about 160 mm to about 180 mm. At this point, adjacent precision wind ratios can be used for the remainder of the yarn winding. This bulky yarn package has an improvement in package density of from about 2% to about 20%, including from about 7% to about 17%, and from about 7% to about 11%, over random wound packages of the same yarn.

In yet another aspect of the disclosed method, the bulky yarn is wound on a tube core using precision non-adjacent wind ratios until a ratio of package diameter to tube core diameter of from about 1.6:1 to about 2.3:1, from about 1.9:1 to about 2.3:1, and from about 2.0:1 to about 2.3:1, is achieved. At this point, adjacent integral and non-integral precision wind ratios can be used for the remainder of the yarn winding.

In yet a further aspect of the disclosed method, the bulky yarn is wound on a tube core, the tube core having an axis, an inner diameter about said axis, an outer diameter about said axis, an outer circumference and a length; the package having an inner diameter equal to the outer diameter of the tube core, an outer diameter, a circumference, a width less than the length of the tube core and having approximately flat sides on planes normal to the axis of the tube core and separated by said width, the method comprising:

(a) rotating the tube core about its axis;

(b) placing a continuous length of bulked continuous filament yarn in contact with the outer circumference of the tube core at an initial location along the length of the tube core;

(c) winding said yarn around the outer circumference of the tube core such that the yarn is taken up by the tube core and the yarn contact location moves around the tube core;

(d) causing the yarn contact location to move in a reciprocating motion along the length of the tube core as the tube core rotates, so that the yarn contact location becomes a moving point on circumference of the package as the package rotates and the package outer diameter increases, and so that the contact location traverses the entire width of the package from side to side on each traverse stroke, forming a package surface at the package outer diameter;

(e) selecting a desired contact location traverse speed in relation to the rotational speed of the rotating package, (f) setting a desired contact location traverse speed control point in relation to the rotational speed of the rotating package;

(g) detecting the actual contact location traverse speed;

(h) adjusting the setting for the contact location traverse speed control point so that the actual speed of traverse converges with the desired speed;

(i) selecting a new desired package rotational speed and a new contact location traverse speed after a specific time interval;

(j) setting the new package rotational speed and yarn contact location traverse speed control point at selected time intervals;

(k) detecting the new actual contact location traverse speeds;

(l) adjusting the settings for the new contact location traverse speeds control points so that the actual speeds of traverse converge with the new desired speeds; and (m) repeating steps (i) through (l) until the package outer diameter reaches a desired value.

In yet even another aspect, a package of bulked continuous filament yarn is disclosed having a ratio of packing density (measured in grams per $cm^3$) to final package diameter (measured in cm) greater than 0.018:1. The ratio can also be from 0.018:1 to about 0.022:1, including 0.019:1 to about 0.022:1, 0.020:1 to about 0.022:1, and about 0.021:1 to about 0.022:1.

In yet even a further aspect, a package of bulked continuous filament yarn is disclosed having a package density increase between about 7% to about 17% compared to the package density of a randomly wound package containing said yarn. The package density increase can also be from about 7% to about 11%.

In another aspect of the disclosed method, the bulked continuous filament yarn is wound on a tube core using at least one non-adjacent wind ratio until said package diameter is from about 47% to about 65% of said final package diameter. At this point, the yarn is wound using at least one precision adjacent wind ratio.

In a further aspect of the disclosed method, the bulked continuous filament yarn is wound on a tube core using a non-adjacent random winding pattern until said package diameter is from about 47% to about 65% of said final package diameter. At this point, the yarn is wound using at least one precision adjacent wind ratio.

In yet another aspect of the disclosed method, the bulked continuous filament yarn is wound on a tube core using a non-adjacent random winding patter until a ratio of package diameter to tube core diameter of from about 1.6:1 to about 2.3:1 is achieved. At this point, the yarn is wound using at least one precision adjacent wind ratio.

In yet a further aspect, a package of bulked continuous filament yarn is disclosed, comprising a packing density of from about 0.4 grams per $cm^3$ to about 0.6 grams per $cm^3$, wherein said package further comprises a non-adjacent winding pattern ending at a package diameter to tube core diameter ratio from about 1.6:1 to about 2.3:1, and a precision adjacent winding pattern starting at a package diameter to tube core diameter ratio from about 1.6:1 to about 2.3:1.

DEFINITIONS

Figure 1A:
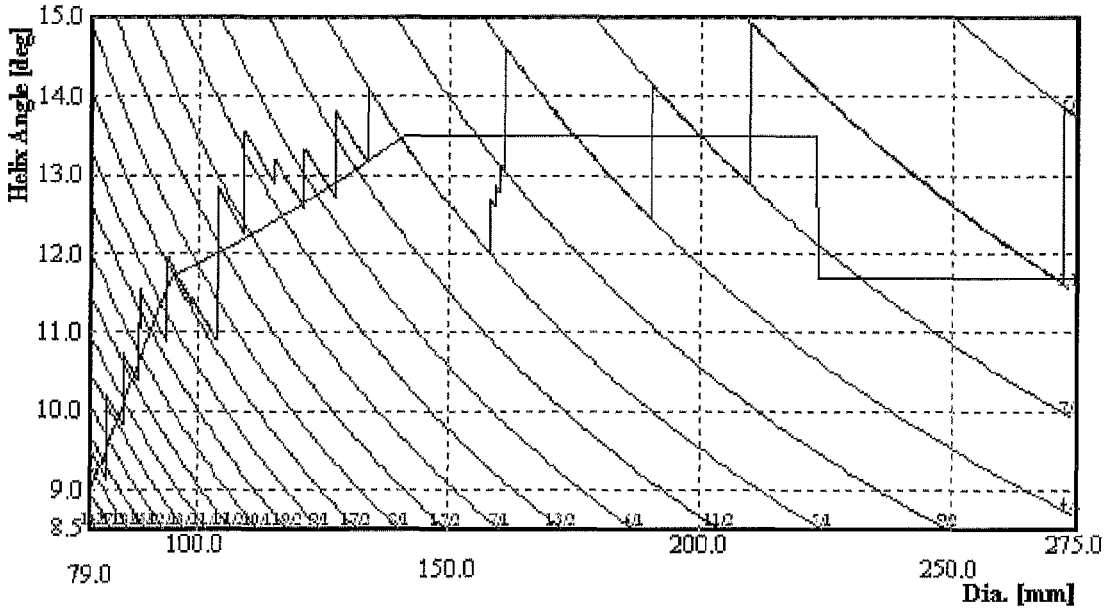
FIG. 1 shows a step precision winding profile having 22 wind ratio set points of one aspect of the disclosed method.

While mostly familiar to those versed in the art, the following definitions of some of the terms used in the instant disclosure are provided in the interest of clarity.

Adjacent: having little or no space intervening between one winding pass and the next on the surface of a yarn package, but where the yarn passes are not actually on top of one another.

Bulk: an inverse measure of yarn density, where higher bulk numbers indicate larger volume occupied by a unit weight of yarn. Bulk is determined after the yarn is heat-set.

Crimp: is the waviness or distortion of a textured yarn and is determined prior to heat-setting.

Denier: part of product description which is the weight per length of yarn (grams/9000 meters). The higher the number, the heavier the yarn or fiber.

Non-integral (e.g. half-integer, quarter-integer) wind ratio: a wind ratio where the number of revolutions of the package per transverse stroke is not a whole number (integer). E.g. 3.5 wind ratio creates 7 bands as the yarn repeats its traverse stroke and pattern on the package.

Integral (Integer) wind ratio: where the number of revolutions of the package per traverse stroke is a whole number; at an integral (integer) wind ratio, e.g. 5.0, the wind ratio there would be exactly 5 bands on top of each other as the yarn repeats its traverse stroke and pattern on the package.

Helix angle: the apparent angle yarn takes with respect to a plane normal to the axis of the tube core at any given point as it is wound about a package; this is also the angle of the yarn path with respect to a perfect package side wall (which should form a plane at 90 degrees to the tube core axis).

Helix angle profile: the relation of helix angle to package diameter.

Jump or step point: a point in time in the winding profile where the package rotational speed and the traverse speed move together to a new set point, also making an abrupt change in helix angle.

Package: a length of yarn wound around a tube of heavy paper or other material such that the wound yarn takes on a cylindrical shape somewhat shorter in length than the tube, with clearly defined flat sides at either end.

Ribbon: synonymous with "band", ribbons are locations where yarn has been wound up or laid down on a package so that each pass or yarn path lays immediately on top of the other (at the same winding helix angle).

Traverse: the action of moving a yarn contact point back and forth along the length of the tube core as the tube core is being rotated, so that the yarn is wound about the tube core to make a package.

Traverse cycle: where the traverse guide or yarn contact point passes from an initial reference point on along the axis of the package to one side of the package, back through the initial reference point to the other side of the package, and then returns to the initial reference point.

Traverse guide: a mechanical device to carry a yarn threadline back and forth from one end of the package to the other while it is being wound around the tube core.

Traverse stroke: the pass of the yarn contact point on the core tube or package from one package side to the other; also, the distance between the package sides through which the traverse moves.

Traverse speed: the speed (linear) with which the yarn contact point traverses the package; the frequency in cycles per minute with which the traverse guide completes a stroke and returns.

Tube core: synonymous with tube; a tube made of paper, cardboard, resin, polymer, combinations thereof, or of other structural material suitable for being rotated at high speed and string enough to resist crushing force to a suitable degree. A typical tube core has a diameter of about 79 mm, however, other diameter available tube cores are available.

Wind ratio: the number of revolutions per minute of the spindle (or tube core) per complete traverse cycle (complete cycle, to and fro).

DETAILED DESCRIPTION OF THE INVENTION

A method is disclosed of creating a BCF package that is surprisingly about 2-20% more dense, including about 7-17% and about 7-11% more dense, than a random wound package of the same yarn type formed at the same tension, while maintaining package formation within the required dimensions for BCF Nylon yarn. The method includes unique, electronic controls and specific winding settings.

The method is a type of precision winding, for the purpose of improving package formation and unwinding. Precision winding uses a series of wind ratio steps to control uniform yarn spacing. In stepped precision winding, a series of wind ratios are used that form a step pattern following a designed helix angle profile (from a graph of helix angle as a function of package diameter). See for example FIGS. 1 and 2.

The highest packing density is adjacent to whole integer and sub-integer ribbons as this is where the tightest spacing between threadlines exists. The desired spacing for adjacent integer wind ratios can be determined by the equation 1 provided below:

$$D_y = \frac{WR_i - WR_a}{WR_i} * TR_{stroke} \quad (1)$$

This equation computes the wind ratio difference between the integer wind ratio ($WR_i$) and the actual wind ratio ($WR_a$) into a center-to-center threadline spacing ($D_y$). $TR_{stroke}$ is length in unit mm of the distance traveled by the traverse in one direction. This equation is useful for determining the wind ratio necessary to achieve a specified spacing from any given integer ribbon.

The winding settings necessary for increased density with successful package formation of BCF nylon yarn include helix angle range, helix angle profile, and specific wind ratio/yarn spacing determination at specific diameters throughout the package. BCF yarn can be any bulked continuous filament yarn, for example a bulk continuous filament nylon yarn with a denier range from about 500 to about 2400 and a crimp between about 10% to about 40%. Compared to the textile yarn winding processes, BCF nylon yarn requires that some special considerations be taken into account when attempting precision winding. This is due to the heavier and bulkier make-up of the yarn coupled with its greater natural lively "springiness" and the finish and additives on the yarn surface, which make it both more susceptible to retraction and more susceptible to sloughing at the reversals due to low friction. Taken together, these factors make BCF package sidewall uniformity very difficult to accomplish with precision winding. Characteristics inherent to precision winding amplify the opportunity for package formation issues due to sloughing at the cam reversals. Closer yarn spacing is typically achieved by precision winding, which creates a greater opportunity for piling of threadlines at the reversals and poor package formation. Also, higher traverse speeds/helix angle precision winding processes tend to have more sloughing because the yarn is always trailing the traverse guide and the traverse stroke length is essentially shortened.

While maintaining a constant wind ratio over a longer duration of the package, the traverse speed is slowing down, and the traverse stroke is, in effect, changing. This slowing down occurs at each wind ratio step where constant wind ratio is maintained. The compounding of this effect throughout the build of the package makes even sidewall formation very difficult to accomplish by precision winding processes of the prior art, due to bulging and saddling at the reversals. Due to this phenomenon, several unique modifications had to be made to the winding method disclosed herein and the manner of its control, which clearly distinguish the winding method disclosed herein from the prior art.

FIGS. 1 and 2 represent winding profiles used to wind samples of Nylon 6,6 according to various aspects of the disclosed method. A Toray NXA/B wind-up was used with both winding profiles. This is a 4-end, spindle driven, automatic doff winder that is capable of being converted to a 2-end process. This winder is capable of spinning BCF nylon yarn of a range of 650-2600 denier at a surface speed of 1100-3100 meters per minute. The yarn can be spun to a maximum package diameter of 275 mm with a 263.5 mm traverse stroke using a motor driven cam to traverse the yarn.

FIG. 1A represents Winding Profile 1 and FIG. 1B represents the wind ratios per step used to wind Samples 1-9 (described below) according to one aspect of the disclosed method. Twenty-two steps are used in Winding Profile 1, where wind ratios that are not adjacent to integral and non-integral ribbons are used (i.e. non-adjacent wind ratios) for the first 13 steps, (i.e. until the package diameter is about 130 mm). The remaining nine steps are at wind ratios that are adjacent to integral and non-integral ribbons (i.e. adjacent wind ratios).

Figure 2A:
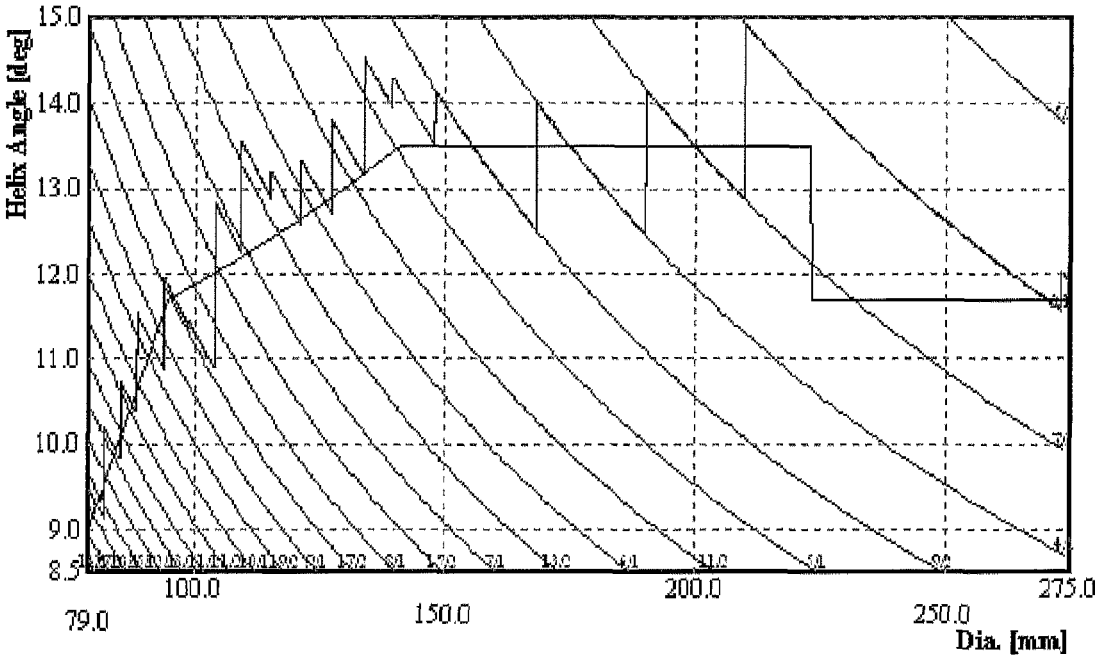
FIG. 2 shows a step precision winding profile having 22 wind ratio set points of another aspect of the disclosed method.

FIG. 2A represents Winding Profile 2 and FIG. 2B represents the wind ratios per step used to wind Sample 10 (described below) according to another aspect of the disclosed process. Twenty-two steps are used in Winding Profile 1, where wind ratios that are not adjacent to integral and non-integral ribbons are used (i.e. non-adjacent wind ratios) for the first 15 steps (i.e. until the package diameter is about 148 mm). The remaining seven steps are at wind ratios that are adjacent to integral and non-integral ribbons (i.e. adjacent wind ratios).

Helix Angle Range

BCF nylon yarn requires a wider range of helix angle in order to achieve higher packing density with sufficiently uniform and stable package formation. In one aspect of the disclosed method, the helix angle ranges from about 9 degrees up to about 15 degrees. This allows for good package build at the core with low helix angle and also allows for much longer yarn layers having adjacent integral and non-integral ribbons later in package build.

In another aspect, the method uses the adjacent integer winding ratios later in package build because speed control is more variable through quarter integer layers and even in some cases with the adjacent half integer wind ratios. Even relatively minute speed variability with feedback control to the drive motor causes variability in the spacing for half and quarter integer wind ratios. Therefore, integer and half integer wind ratios are preferred at the outer layers of the package where higher overall density can be accomplished efficiently.

Helix angle can be determined with the following equation:

$$\tan\theta = \frac{V_h}{V_v} \quad (2)$$

where $V_h$ is the horizontal yarn speed and $V_v$ is the vertical yarn speed. $V_h$ can be determined with the following equation:

$$V_h = 2Td_s \quad (3)$$

where T is the traverse speed in cycles per minute and $d_s$ is the traverse stroke, which is the distance swept by the traverse guide as it moves from one side of the package to the other. $V_v$ can be determined with the following equation:

$$V_v \pi S d_p \quad (4)$$

where S is the spindle speed in rpm and $d_p$ is the package diameter. Yarn velocity can be calculated using $V_h$ and $V_v$ as follows:

$$V_y = \sqrt{(V_h^2 + V_v^2)} \quad (5)$$

In most cases, $V_y$ is fixed, since it is desired to maintain a constant tension in the yarn.

Helix Angle Profile

The disclosed method can use a helix angle profile that starts at a helix angle of about 9 degrees at the beginning of the package, peaks at about 15 degrees towards the middle of the package, and drops to about 11 degrees at the surface of the completely wound package. This helix angle profile results in a 2-20% density improvement, including about a 7-17% and about a 7%-11% increase, over random winding methods while maintaining sufficient package uniformity and stability. In order to prevent excessive "pull-back" at reversals due to high traverse speed at the beginning of the package, the initial helix angle must start low and then work its way higher as the spindle speed decreases, which occurs at a relatively rapid rate of change at the beginning of a BCF package. As the spindle speed reduction rate levels off, the helix angle can also be leveled off, and can actually be allowed to peak and then decrease without causing significant package formation issues. Towards the end, or surface, of the BCF package, the helix angle is preferably allowed to ramp down from its peak value in order to maintain a constant winding ratio and maximize package density.

Wind Ratio at Specific Diameters of Package

Wind ratios adjacent to integer and sub-integer ribbons are avoided through a substantial fraction of the package. The core of a BCF package should be allowed to build with wider spacing between the threadlines, and that wind ratios adjacent to integer and sub-integer ribbons should be avoided within this core in order to achieve a successful package formation (i.e. non-adjacent wind ratios). Then, only after achieving a package diameter from about 130 mm to about 180 mm, including from about 150 mm to about 180 mm, and from about 160 mm to about 180 mm, wind ratios adjacent to integral and non-integral ribbons can be used without adversely affecting the quality of BCF package formation. (i.e. adjacent wind ratios). Alternatively, random winding can be employed instead of alternative precision non-adjacent wind methods within the first approximately 130 mm to about 180 mm, including from about 150 mm to about 180 mm, and from about 160 mm to about 180 mm, of package formation without significantly compromising package quality and overall package density.

After the package diameter has reached about 130 mm to about 180 mm, including from about 150 mm to about 180 mm, and from about 160 mm to about 180 mm, it then becomes possible to choose adjacent integral and non-integral wind ratios as part of the yarn lay down pattern on the yarn package. When choosing the appropriate integer adjacent wind ratio, the actual wind ratio chosen using the afore mentioned spacing equation should always be less than the integer ribbon. This winding ratio pattern results in a 2-20% density improvement, including about a 7-17% and about a 7%-11% increase, over random winding methods while maintaining sufficient package uniformity and stability.

Wind ratio can be calculated using the following equation:

$$W = \frac{S}{T} \tag{6}$$

where S and T are spindle speed and traverse speed described above.

Traverse Cam Control at Doffing

While not intended to be limiting, as various alternative means may be contemplated to accomplish the control strategy of the disclosed method with different traverse drives, the following approach enables effective traverse control of induction motor driven traverse cams.

Figure 3:
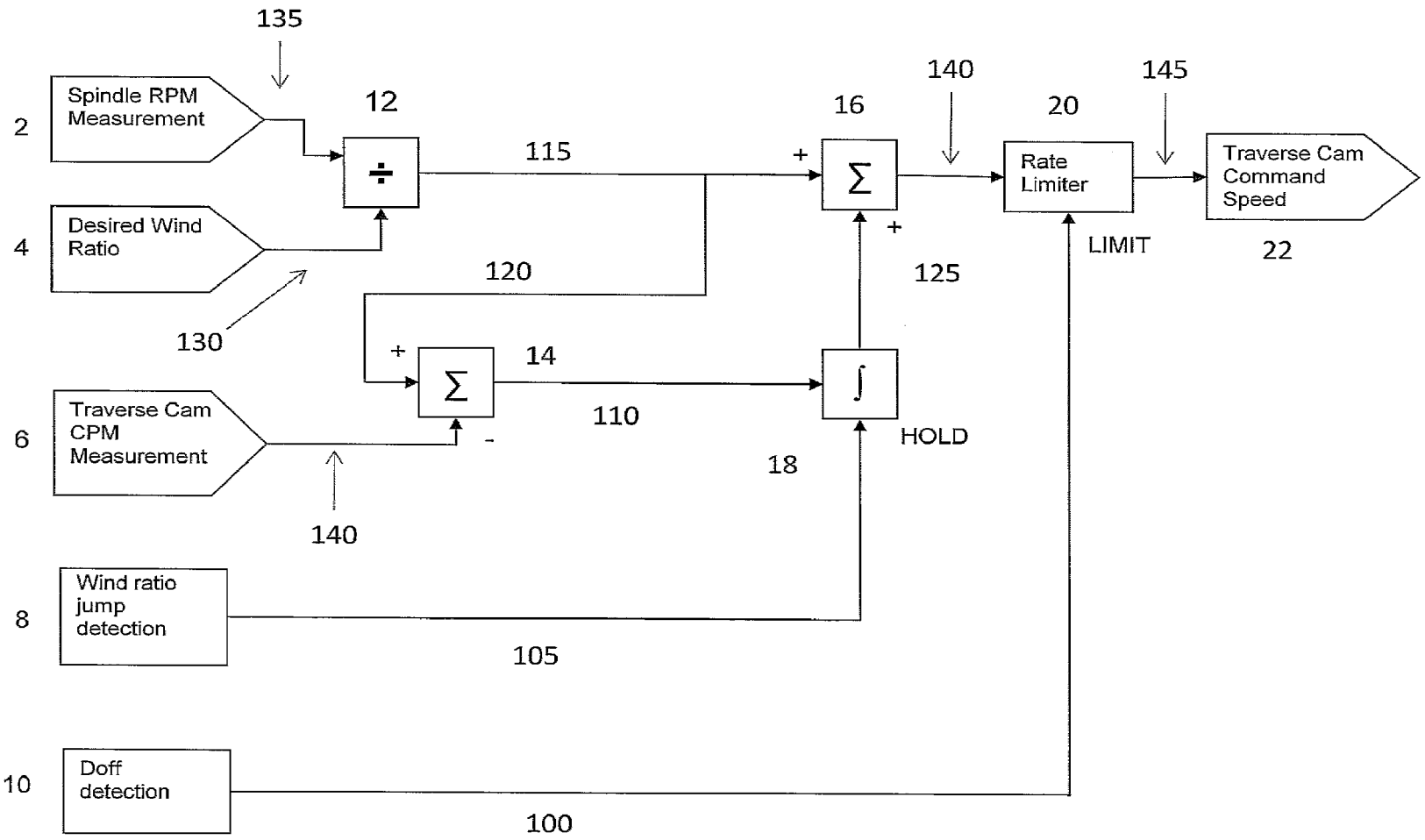
FIG. 3 is a winding control strategy according to the disclosed method.

FIG. 3 discloses a winding control strategy that can be used in the winding of BCF yarns according to the disclosed method. Spindle RPM measurement input 2 and desired wind ratio input 4 are connected to processor 12 via control signals 135 and 130, respectively. Processor 12 computes a traverse speed signal 115 using equation 7, which is sent to processor 16 and processor 14, via signal 120. Processor 14 also receives traverse cam CPM measurement input 6 via control signal 140. Processor 14 sends the combined signal 110 to integral component 18. The software components of the functional blocks in FIG. 3 are programmed to interact rapidly and precisely using components and methods known in the art, such as a programmable logic controller (PCL) or dynamic random access memory. While various alternative modern computational equipment types or arrangements may be contemplated, it is the logic of the strategy that enables effective control of both winder and traverse for precision winding of BCF yarn according to the disclosed method.

Where the traverse cam is driven by an induction motor supplied from a variable frequency drive, there is an inherent limitation in the rate at which the driven load speed can be changed. Due to the unique helix angle profile for the precision winding method disclosed here, an especially rapid change in traverse cam speed is commanded at doffing, which may exceed the rate of change limitation for the induction drive. Without the following improvement, the drive would tend to trip due to the rapid change in commanded speed, causing the winder to shut down.

The speed change limitation problem described above may be avoided by introduction of a separate input 10 and signal 100 internal to the PLC at the moment that the winder starts the doffing sequence that causes the output to the traverse cam drive to be filtered. This filtering, rate limiter 20, constrains the rate of change of the drive command signal 145 such that the inherent physical limits of the drive are not exceeded while the package is doffed and a new package is initiated. Rate limiting causes the outer layer of the package to have a random pattern that improves handling due to decrease risk of sloughing.

Traverse Speed Control

Precision winding requires precise and repeatable control of traverse cam speed so that the actual winding ratio does not deviate significantly from the desired ratio. The method disclosed herein uses a unique speed control strategy, which enables the extremely precise control of the traverse cam speed which is required for building efficiently laid BCF yarn packages with the desired package form.

Referring to FIG. 3, the speed of the traverse cam is monitored 6 and an actual speed signal 140 is calculated and inputed to the programmable controller. The controller then implements a combined feed forward and feedback speed control loop as shown in FIG. 3. The feedback component has integral-only action, integral component 18, with a low gain signal 125. The low gain signal 125, serves to slowly adjust the output to the traverse cam drive, which is combined with the target traverse speed signal 115 at component 16 to form combined signal 140, such that the error between commanded and actual speed is driven to near zero. Low gain improves noise immunity and reduces the variability of the resulting wind ratio. The feed forward component calculates the speed command 22 that would result in the correct traverse cam speed in the absence of motor slip.

The integral component 18 can be in running state (integrates its input value) or holding state (output of integrator is constant). The integral 18 is put into holding state when the wind profile causes a jump in commanded wind ratio, detected by wind jump detection 8 and sent to integral component 18 via signal 105. This ensures the integral component 18 responds only to motor slip at steady state.

The command speed of the traverse cam 22 is calculated directly by measurement of the spindle speed (rpm) and dividing this spindle speed value by the desired wind ratio using the following equation:

$$T_t = \frac{S}{W_t} \tag{7}$$

where $W_t$ is the desired wind ratio and $T_t$ is the desired traverse cam speed.

Tension Loss Compensation

Spindle speed is typically controlled to maintain constant package surface speed or yarn speed ($V_y$). Because of the unique winding profile of the disclosed method, yarn tension can be lost as helix angle decreases. Similarly, yarn tension can increase as the helix angle at the various set points increases. To compensate for this change in tension and maintain a constant yarn speed, spindle speed must be varied throughout the winding process.

The below equation shows the relationship between spindle speed, yarn speed, desired winding ratio, package diameter, and traverse stroke used in the disclosed method to maintain constant tension.

$$S = \sqrt{\frac{V_y^2}{\left(\left(\frac{2d_s}{W_t}\right)^2 + (\pi d_p)^2\right)}} \tag{8}$$

Equations 2-8 can be utilized in the control strategy in FIG. 3, where the spindle speed is controlled to partially compensate for tension variation using a two component strategy. One component adjusts spindle speed to maintain the surface speed of the package at a constant value throughout the package build with the value being selected according to yarn type. The second component calculates an adjustment to the target surface speed to partially counteract the tension variation caused by changes in helix angle. The adjustment is rate limited to avoid control loop instability and to avoid integral wind ratios at the jump or set points in the profile.

Backwinding Method

Backwinding is a process by which a full tube of yarn can be spun under specified conditions onto another empty tube. The conditions by which this process should be run are listed in the table below.

| | |
|---|---|
| Helix Angle | 14.5 degrees<br>Control Limit = +/−0.5 degrees<br>Segregation Limit = N.A. |
| Winding Speed-Drive Roll | 11,680 rpm (1400 ypm)<br>Control Limit = +/−100 rpm<br>Segregation Limit = N.A. |
| Chuck Pressure | Setting = 32 Pounds<br>Control Limit = +/−2 Pounds<br>Segregation Limit = N.A. |
| Cleaner Guide | Clearance .040 Inches (All Products) |
| DENIER 650-850 | Winding Tension<br>Aim = 180 Grams<br>Control Limit = +/−50 |
| DENIER 995-1250 | Winding Tension<br>Aim = 250 Grams<br>Control Limit = +/−50 |
| DENIER 1260-1500 | Winding Tension<br>Aim = 300 Grams<br>-Control Limit = +/−50 |
| DENIER 1510-1850 | Winding Tension<br>Aim = 350 Grams<br>-Control Limit = +/−50 |
| DENIER 1860+ | Winding Tension<br>Aim = 400 Grams<br>-Control Limit = +/−50 |

These conditions are necessary for achieving repeatable results across an array of products. The backwound tube must be run to a minimum of 10 inches in diameter in order for package density to be valid.

EXAMPLES

The following are examples of Nylon 6,6 BCF yarn packages wound according to various methods, including random winding and aspects of the disclosed method using a Toray NXA/B wind-up. It should be understood that a common feature of nylon BCF and other "bulky" yarns is their tendency to resilient recovery or "pull-back" from the edge of the package, and their tendency to lag behind the traverse guide as a result of air friction. Selection of alternative yarns and polymers having different bulk and recovery features will necessitate minor adjustments to the profiles described.

Test Methods

Packing density is measured by dividing the weight of a wound package of bulked continuous yarn (in grams) by the volume of yarn (in $cm^3$). In all cases, standard tube cores were used with a fixed weight.

Dynafil™ Crimp Force ("Crimp Force") is measured according to the test method in Morschel, U; Paschen, A.; Stein, W.: *BCF yarn testing with Dynafil ME*, Chemical Fibers International, 53, pp. 204-206 (2003) (herein incorporated by reference). When the BCF nylon yarn is tested on a Dynafil™ instrument depending on the yarn speed, amount of yarn overfeed at the top roll and the heater temperature, there is a force developed on the Tensiometer due to resistance to shrinkage. At yarn speeds below approximately 100 mpm (meters per minute), the force is primarily due to the shrinkage of the yarn referred to as Shrinkage Force (1). At higher speeds of over 120 mpm, the maximum yarn temperature attained is relatively lower and a lower force is developed, referred to as Crimp Force. The measurements reported below were done on the Dynafil™ at 150 mpm yarn speed under a pretension of 0.1 gpd, heater temperature of 207° C. and 3% overfeed from the top roll.

Table 1, below, lists the various yarns wound according to the random method and different aspects of the disclosed method:

| Sample # | INVISTA Product # | Cross-Section | Denier | Crimp Force at 150 mpm. |
|---|---|---|---|---|
| 1 | 966-80-826 | Modified Trilobal | 966 | 7.50 |
| 2 | 995-80-476 | Mickey with Three lobes | 995 | 5.35 |
| 3 | 1045-80-276AS | Mickey with Three lobes | 1045 | 5.80 |
| 4 | 1120-61-736AS | Modified trilobal | 1120 | 11.37 |
| 5 | 1130-68-746 | Trilobal | 1130 | 9.38 |
| 6 | 1185-68-846 | Trilobal | 1185 | 9.61 |
| 7 | 1205-68-746 | Modified Trilobal | 1205 | 10.94 |
| 8 | 1340-68-416 | Trilobal | 1340 | 11.33 |
| 9 | 1491-68-246 | Trilobal | 1491 | 14.42 |

-continued

| Sample # | INVISTA Product # | Cross-Section | Denier | Crimp Force at 150 mpm. |
|---|---|---|---|---|
| 10 | 1045-80-276AS | Mickey with Three lobes | 1045 | 5.80 |

Example 1

Example 1 compares the package density (grams per $cm^3$) of yarn Samples 1 to 9 wound using a random winding method and the precision winding method described above in FIG. 1.

| Sample # | Density - Random ($g/cm^3$) | Density - FIG. 1 ($g/cm^3$) | Packing Density Increase (%) |
|---|---|---|---|
| 1 | 0.46 | 0.511 | 11.1 |
| 2 | 0.57 | 0.6115 | 7.3 |
| 3 | 0.53 | 0.575 | 8.5 |
| 4 | 0.37 | 0.43 | 16.2 |
| 5 | 0.503 | 0.55 | 9.3 |
| 6 | 0.4915 | 0.54 | 9.9 |
| 7 | 0.38 | 0.44 | 15.8 |
| 8 | 0.42 | 0.49 | 16.7 |
| 9 | 0.41 | 0.45 | 9.8 |

Example 2

Example 2 compares the packing density (grams per $cm^3$) of yarn Sample 10 wound using a random winding method and the precision winding method described above in FIG. 2.

| Sample # | Density - Random ($g/cm^3$) | Density - FIG. 2 ($g/cm^3$) | Packing Density Increase (%) |
|---|---|---|---|
| 10 | 0.4904 | 0.5036 | 2 |

The invention has been described above with reference to the various aspects of the disclosed method and products. Obvious modifications and alterations will occur to others upon reading and understanding the proceeding detailed description. It is intended that the invention be construed as including all such modifications and alterations insofar as they come within the scope of the claims.

What is claimed is:

1. A method of making a package of bulked continuous filament yarn wound on a tube core, the tube core having an axis, an inner diameter about said axis, an outer diameter about said axis, an outer circumference and a length; the package having an inner diameter equal to the outer diameter of the tube core, an outer diameter, a circumference, a width less than the length of the tube core and having approximately flat sides on planes normal to the axis of the tube core and separated by said width, the method comprising:

(a) rotating the tube core about its axis;

(b) placing a continuous length of bulked continuous filament yarn in contact with the outer circumference of the tube core at an initial location along the length of the tube core;

(c) winding said yarn around the outer circumference of the tube core such that the yarn is taken up by the tube core and the yarn contact location moves around the tube core;

(d) causing the yarn contact location to move in a reciprocating motion along the length of the tube core as the tube core rotates, so that the yarn contact location becomes a moving point on circumference of the package as the package rotates and the package outer diameter increases, and so that the contact location traverses the entire width of the package from side to side on each traverse stroke, forming a package surface at the package outer diameter;

(e) selecting a desired contact location traverse speed in relation to the rotational speed of the rotating package, (f) setting a desired contact location traverse speed control point in relation to the rotational speed of the rotating package;

(g) detecting the actual contact location traverse speed;

(h) adjusting the setting for the contact location traverse speed control point so that the actual speed of traverse converges with the desired speed;

(i) selecting a new desired package rotational speed and a new contact location traverse speed after a specific time interval;

(j) setting the new package rotational speed and yarn contact location traverse speed control point at selected time intervals;

(k) detecting the new actual contact location traverse speeds;

(l) adjusting the settings for the new contact location traverse speeds control points so that the actual speeds of traverse converge with the new desired speeds; and (m) repeating steps (i) through (l) until the package outer diameter reaches a desired value.

2. The method of claim 1, further comprising selecting a first contact location traverse speed so that the number of package rotations per traverse cycle results in a non-adjacent winding pattern; and selecting additional contact location traverse speeds so that the number of package rotations per traverse cycle is not adjacent until the package outer diameter is from about 130 mm to about 180 mm.

3. The method of claim 1, further comprising selecting the first contact location traverse speed so that the number of package rotations per traverse cycle is random; and selecting additional contact location traverse speeds so that the number of package rotations per traverse cycle is not adjacent until the package outer diameter is from about 150 mm to about 180 mm.

4. The method of claim 1, further comprising selecting the first contact location traverse speed so that the number of package rotations per traverse cycle results in a non-adjacent winding pattern; and selecting additional contact location traverse speeds so that the number of package rotations per traverse cycle is not adjacent until the package outer diameter is from about 130 mm to about 180 mm.

5. The method of claim 1, further comprising selecting the contact location traverse speed so that the number of package rotations per traverse cycle is adjacent but less than an integer or half integer after the package outer diameter is from about 150 mm to about 180 mm.

* * * * *